US007594884B2

(12) United States Patent
Robert et al.

(10) Patent No.: US 7,594,884 B2
(45) Date of Patent: Sep. 29, 2009

(54) FOLDING DEVICE

(75) Inventors: Jean-Francois Robert, Creil (FR); Alain Blanchard, Gouvieux (FR)

(73) Assignee: Goss International Montataire SA, Montataire (FR)

( * ) Notice: Subject to any disclaimer, the term of this patent is extended or adjusted under 35 U.S.C. 154(b) by 118 days.

(21) Appl. No.: 11/644,583

(22) Filed: Dec. 20, 2006

(65) Prior Publication Data

US 2007/0144324 A1 Jun. 28, 2007

(30) Foreign Application Priority Data

Dec. 27, 2005 (FR) ..... 05 13382

(51) Int. Cl.
*B31F 1/00* (2006.01)

(52) U.S. Cl. ..... 493/432; 493/428; 493/364; 493/353

(58) Field of Classification Search ..... 493/432, 493/365, 324, 364, 370, 340, 353, 428
See application file for complete search history.

(56) References Cited

U.S. PATENT DOCUMENTS 3,859,879 A * 1/1975 Spengler ..... 83/155
4,465,269 A 8/1984 Petersen
4,957,280 A 9/1990 Motooka
4,983,155 A * 1/1991 Stobb ..... 493/369
5,103,703 A * 4/1992 Littleton ..... 83/155
5,107,733 A * 4/1992 Palmatier et al. ..... 83/176
5,230,268 A * 7/1993 Richter ..... 83/303
5,363,728 A * 11/1994 Elsner et al. ..... 83/23
5,484,379 A * 1/1996 Stab ..... 493/359
6,280,373 B1 * 8/2001 Lanvin ..... 493/227
6,604,444 B1 * 8/2003 Belanger et al. ..... 83/155
7,329,219 B2 * 2/2008 Blanchard et al. ..... 493/365
2004/0058793 A1 3/2004 Blanchard et al.
2007/0270297 A1 * 11/2007 Blanchard et al. ..... 493/432

FOREIGN PATENT DOCUMENTS

EP 1 362 819 11/2003

* cited by examiner

*Primary Examiner*—Sameh H. Tawfik
(74) *Attorney, Agent, or Firm*—Davidson, Davidson & Kappel, LLC

(57) ABSTRACT

A folding device capable of folding signatures and includes a blade cylinder, which is provided with at least one blade; a counter-pressure cylinder, which is provided with at least two counter-pressure elements which together define an axial gap; and a conveying element which is capable of conveying a signature, and which extends in the axial gap. The blade extends over the axial gap and the conveying element extends in the axial gap with spacing from the blade when the blade co-operates with the counter-pressure elements.

21 Claims, 7 Drawing Sheets

FIG.5
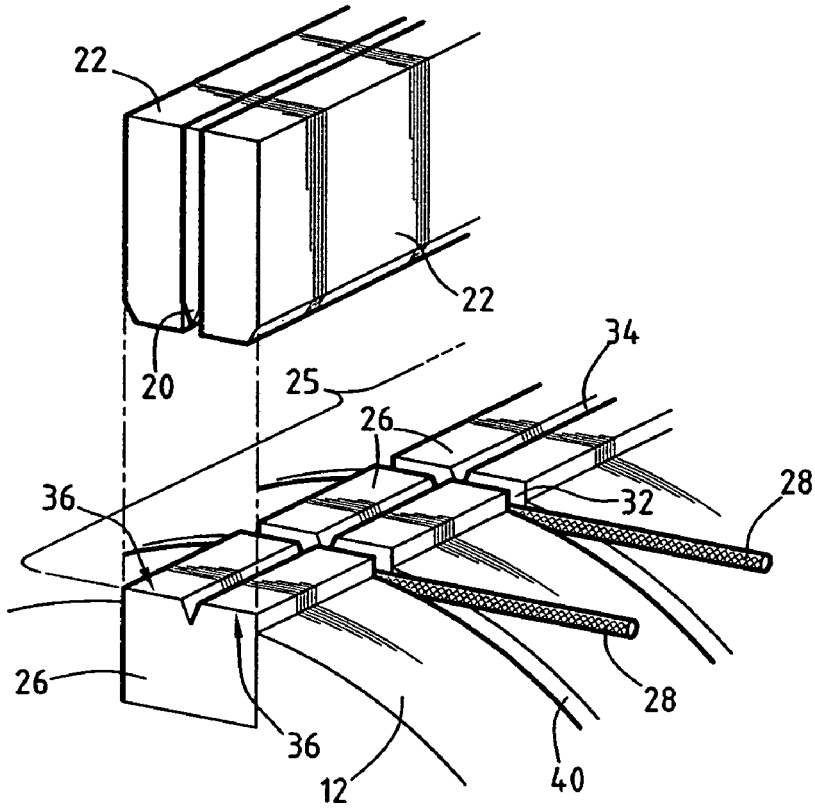
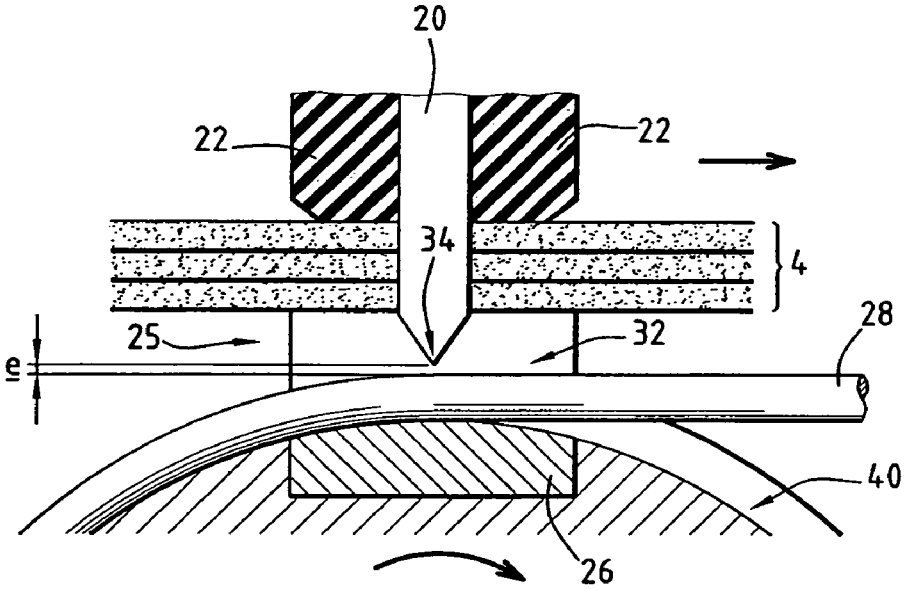
FIG.6

FOLDING DEVICE

This claims priority to the French patent application number 05 13382, filed Dec. 27,2005, and hereby incorporated by reference herein.

The present invention relates to a folding device, in particular for a rotary press, capable of folding signatures, of the type comprising:

a blade cylinder which is provided with at least one blade which is capable of cutting a printed web of material, a counter-pressure cylinder which is provided with at least two counter-pressure elements which together define an axial gap, the blade pressing on the two counter-pressure elements during the cutting operation, a conveying element which extends around the counter-pressure cylinder, which at least partially surrounds the blade cylinder, and which is capable of conveying the web and/or a signature cut from the web at least downstream of the cutting location, and which extends in the axial gap when the blade co-operates with the counter-pressure elements.

BACKGROUND TO THE INVENTION

Document EP-A-1 362 819 discloses a folding device for a rotary press which comprises a blade cylinder or cutting cylinder provided with a blade which is capable of cutting a printed web of material and a plurality of counter-pressure elements which co-operate with the blade and which are arranged so as to form axial gaps between each other.

Web traction belts extend in the axial gaps which serve to guide the printed web or the cut signature. The toothed belts comprise counter-pressure elements which are placed in the axial gaps. The blade also presses on the counter-pressure elements of the belts during the cutting operation.

This folding device has the disadvantage that the belts rapidly become damaged by the blade and must be changed regularly.

SUMMARY OF THE INVENTION

An object of the present invention is to overcome the disadvantage and provide a folding device which has longer maintenance intervals.

The present invention provides a folding device wherein the blade extends over the axial gap and the conveying element extends in the axial gap with spacing from the blade when the blade co-operates with the counter-pressure elements.

According to specific embodiments, the folding device comprises one or more of the following features:

the axial width of the axial gap may be sufficiently small for the web to be cut by the blade in the entire zone corresponding to the axial gap;

the blade cylinder carries a plurality of blades being distributed over the circumference of the blade cylinder;

the blade cylinder including devices for gripping the cut signatures, for example, pincers;

the blade cylinder capable of being rotatably driven so that the peripheral speed of the blade cylinder is greater than the travel speed of the printed web of material;

the blade cylinder capable of being rotatably driven so that the peripheral speed of the blade cylinder is equal to the travel speed of the printed web of material;

the counter-pressure cylinder carries one assembly of counter-pressure elements;

the blade being retracted behind the covering surface of the blade cylinder, and the blade being surrounded by protection blocks being of rubber and capable of protecting the conveying element extending around the blade cylinder;

the conveying element includes at least a first belt provided with a transport surface being smooth directed towards the printed web of material during operation;

the first belt has a round or rectangular cross-section;

the first belt extends around the blade cylinder upstream of the cutting location and capable of retaining the web during the cutting operation;

a single bank of one or more first belts surrounding the counter-pressure cylinder and extending around the blade cylinder as far as a location for transfer of the signature, and the bank being capable of transporting the signatures from the cutting location to the transfer location;

the folding device comprises a first bank of belts constituted by a plurality of first belts surrounding the counter-pressure cylinder and are imbricated with a second bank constituted by second belts, the first and second belt banks capable of transferring a signature from the first belt bank to the second belt bank;

the second belt bank extends around the blade cylinder and capable of retaining the cut signatures on the surface of the blade cylinder, the speed of the belts of the second belt bank being identical to the tangential speed of the blade cylinder;

the folding device capable of driving each conveying element at a speed equal to or greater than the transport speed of the web; and the folding device capable of driving each conveying element at a speed greater than the transport speed of the web and less than or equal to the transport speed of the signatures, and less than the transport speed of the signatures.

BRIEF DESCRIPTION OF THE DRAWINGS

The present invention will be better understood from a reading of the following description, given purely by way of example and with reference to the appended drawings, in which:

FIG. 5 is a perspective view of a portion of the counter-pressure cylinder and the blade cylinder;

FIG. 6 is a side view of a detail of the blade cylinder and the counter-pressure cylinder, at the time of the cutting operation;

DETAILED DESCRIPTION OF PREFERRED EMBODIMENTS

Figure 1:
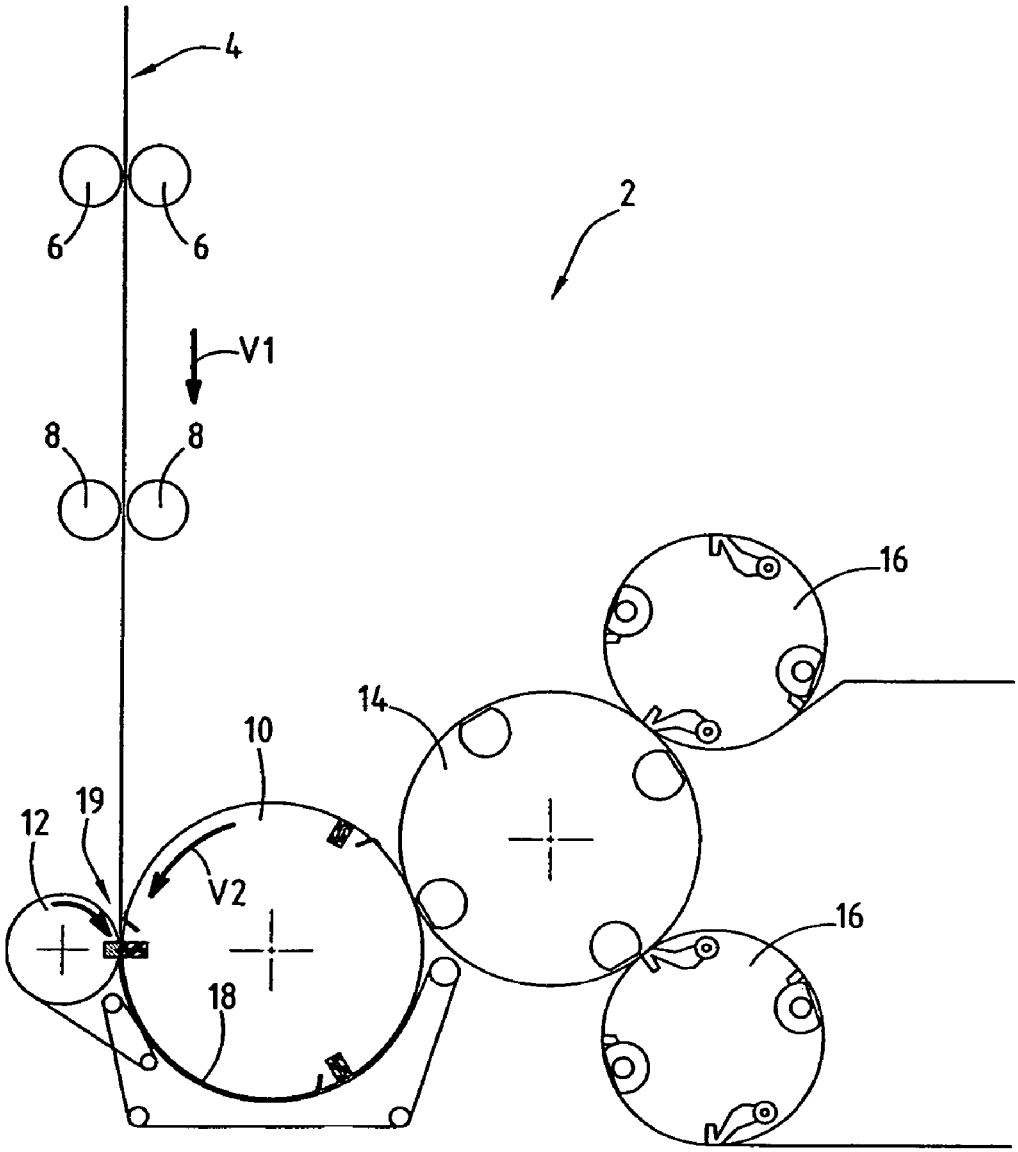
FIG. 1 is a schematic side view of a folding device according to the present invention.
Figure 2:
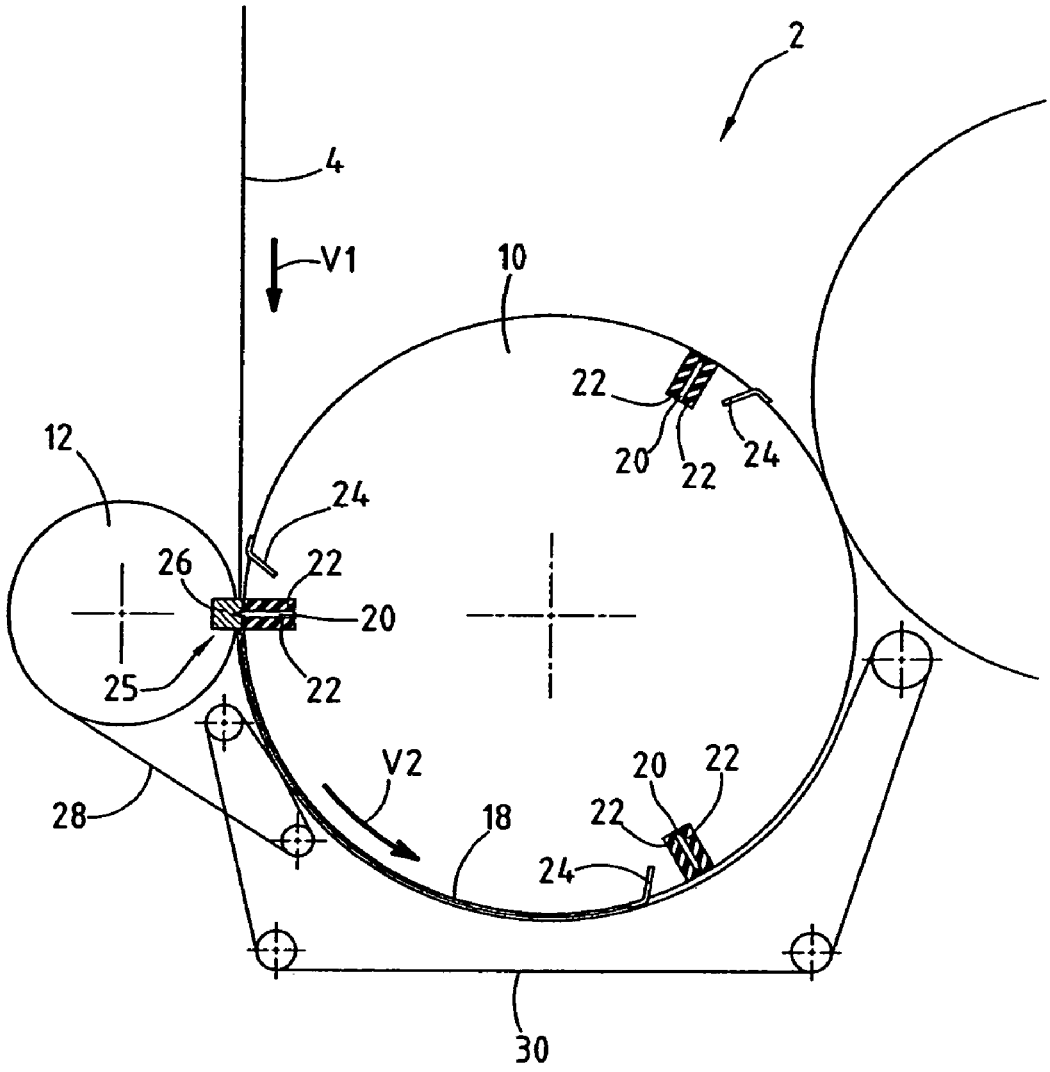
FIG. 2 is an enlarged view of a detail of FIG. 1.
Figure 3:
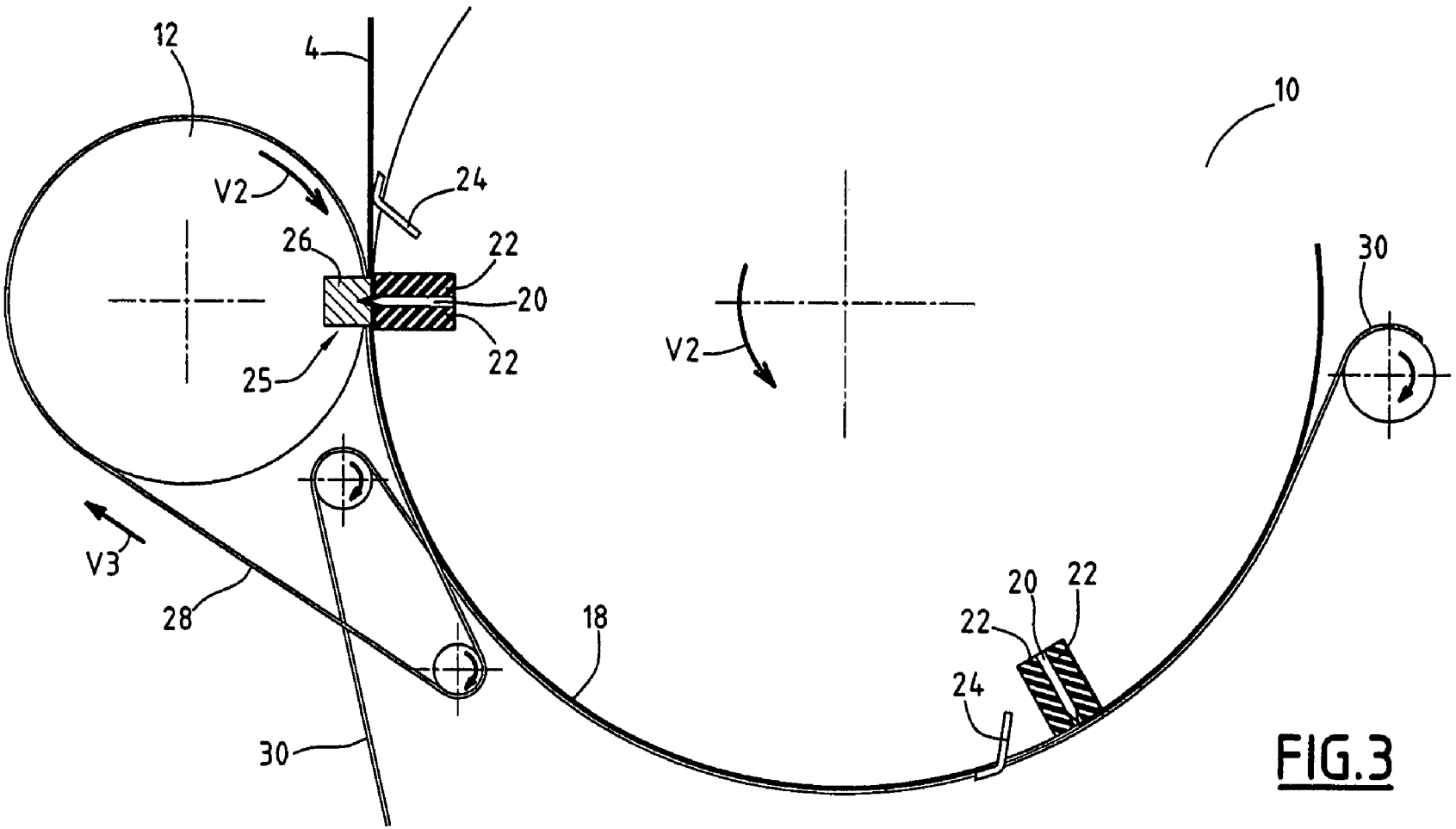
FIGS. 3 and 4 illustrate enlarged details of FIG. 2, during the different operating phases of the folding device.
Figure 4:
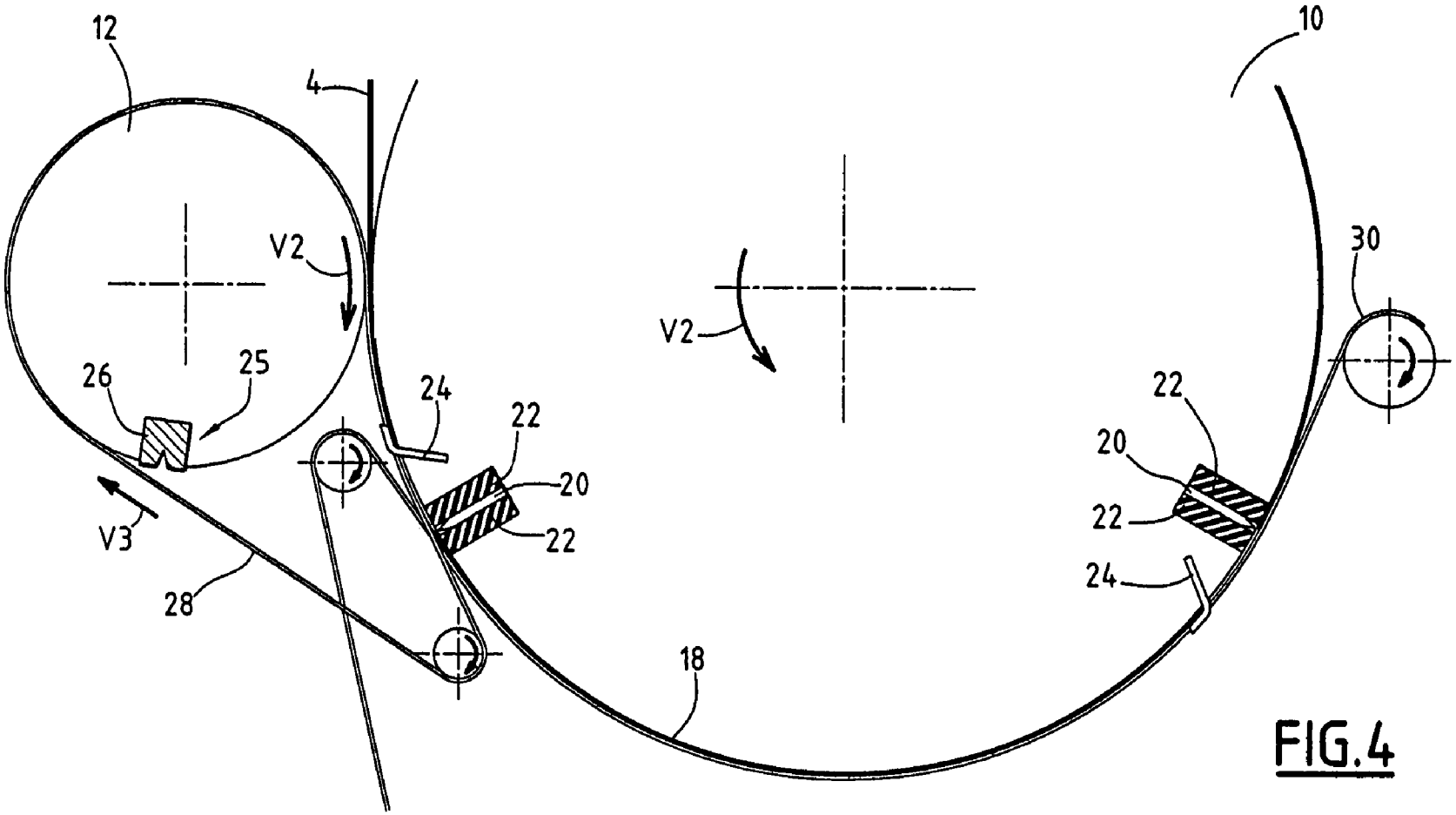

FIG. 1 illustrates a folding device 2 according to the invention.

The folding device 2 is capable of cutting and folding a printed web of material, such as a web of paper 4. The web of paper 4 may have one or more layers. The web 4 is driven with a web speed $V_1$.

The folding device 2 is equipped with two pairs of cylinders 6 and 8 for traction of the web 4. The folding device 2 includes a blade or fold cylinder 10, a counter-pressure cylinder 12, a transfer cylinder 14 and two transfer cylinders 16 having pincers.

The folding device 2 is capable of cutting the web 4 into signatures 18 or sheets 18 and transporting the signatures/sheets with a signature speed $V_2$ which is preferably greater than the web speed $V_1$.

To this end, the blade cylinder or fold cylinder 10 and the counter-pressure cylinder 12 together define a cutting location 19 which corresponds to the closest location between these two cylinders 10, 12. Furthermore, the blade cylinder 10 has a peripheral speed which is equal to the signature speed $V_2$. The rotation speed of the counter-pressure cylinder 12 is adapted to the speed of the blade cylinder 10 so that a counter-pressure element 26 is always present when a blade 20 presses on the web 4 in order to cut it.

The blade cylinder 10 includes three blades 20 being distributed regularly over the circumference of the cylinder 10. The blades 20 are fixed to the blade cylinder 10 in a retracted position in which the cutting edge of the blade 20 is retracted behind the circumference of the cylinder 10. Each blade 20 preferably extends in an uninterrupted manner over the entire axial width of the web 4 to be cut or the blade cylinder 10.

For each blade 20, the blade cylinder 10 is further provided with two protection blocks 22 of resilient material, such as rubber, which extend at one side and the other of the associated blade 20.

Pincers 24 which are capable of holding cut signatures 18 are also arranged on the blade cylinder 10.

The counter-pressure cylinder 12 includes one or more counter-pressure assemblies 25, each of which is provided with a plurality of counter-pressure elements 26 which will be explained in greater detail below.

The folding device 2 is provided with a plurality of first conveying elements, in the form of a first bank of first belts 28 which extend around the counter-pressure cylinder 12, which press on a segment of the surface of the blade cylinder 10 and on a segment of the surface of the counter-pressure cylinder 12. These belts 28 are capable of conveying the web 4 and/or a cut signature 18 downstream of the cutting location 19. Each first belt 28 comprises a round or rectangular cross-section and a smooth or slightly rough transport surface. This smooth surface reduces the soiling of the web. Each first belt 28 has a speed which is equal to or greater than the web transport speed $V_1$. In a preferred configuration, the first belts 28 are driven at a speed which is greater than the web speed $V_1$, and equal to or less than the signature speed $V_2$ and in particular strictly less than the signature speed $V_2$. In this manner, the traction of the belts 28 on the web 4 and on the signatures 18 is limited and protects the paper.

Figure 7:
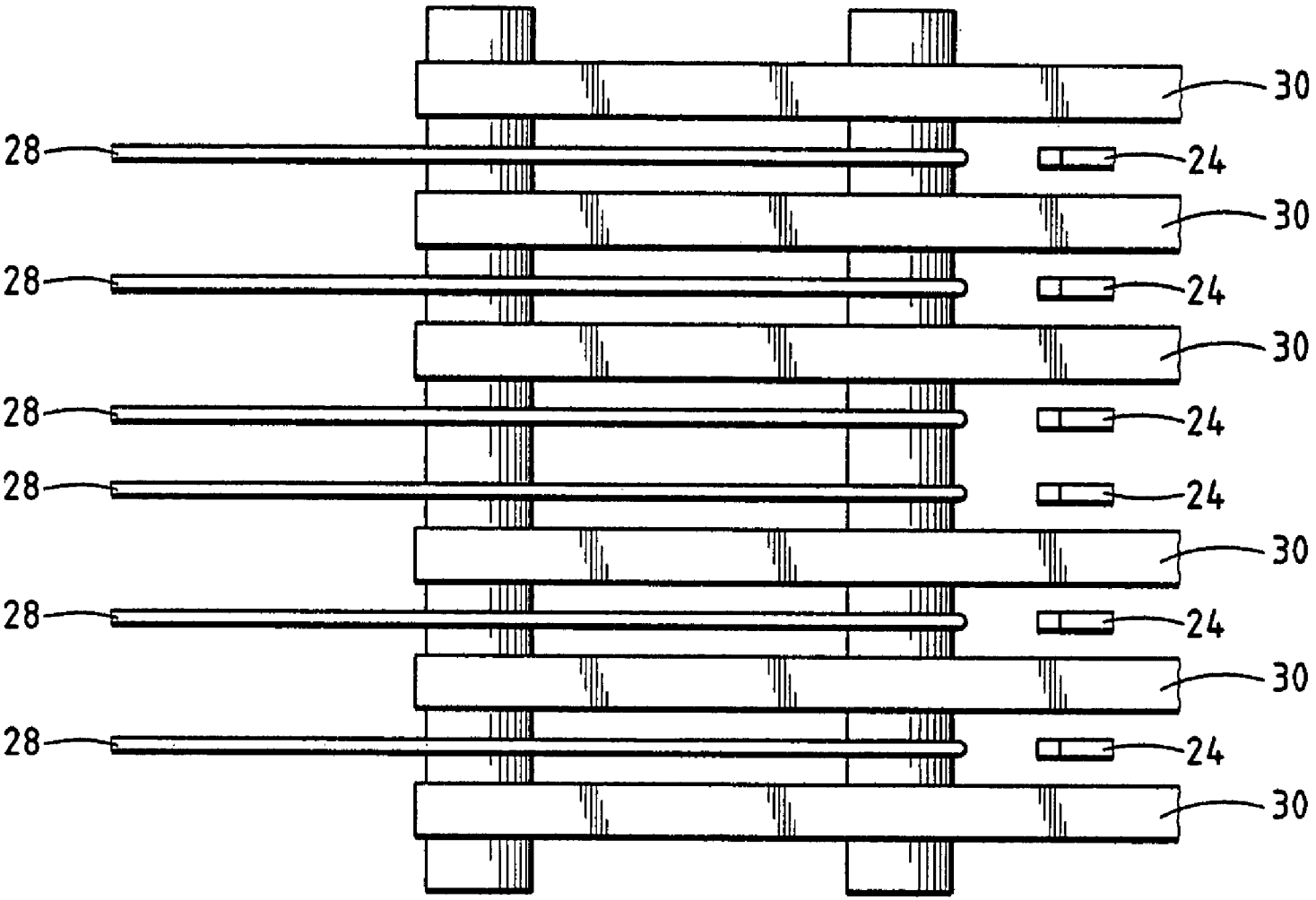
FIG. 7 is a schematic view of the conveying belts.

The folding device 2 further includes a plurality of second conveying elements, in this instance, belts 30 which form a second bank of belts. As can be seen in FIG. 7, the belts 30 of the second belt bank are imbricated between the belts of the first belt bank 28 so that a signature head 18 can pass from the first belt bank 28 to the second belt bank 30. The speed of the belts of the second belt bank 30 being identical to the peripheral speed of the blade cylinder 10.

The protection blocks 22 are capable of contributing to protecting, on the one hand, the first belts 28 and, on the other hand, the second belts 30, against wear by the blades 20.

Furthermore, these protection blocks 22 keep the web 4 of paper pressed against the counter-pressure elements 26 at the time of the cutting operation.

FIG. 5 is a perspective view of a detail of the counter-pressure cylinder 12. As can be seen, the counter-pressure elements 26 are arranged axially one behind the other in an aligned manner, together forming gaps 32 in which the first belts 28 engage during the cutting of the web of paper 4.

Each counter-pressure assembly 25 extends axially along the counter-pressure cylinder 12.

Each counter-pressure element 26 comprises a cutting groove 34 which extends axially and in which the blade 20 engages during the cutting operation. At each side of the groove 34, there is arranged a support surface 36 which extends parallel with a tangent of the surface of the blade cylinder 10 and which receives the web of paper 4 under the action of the protection blocks 22 at the time of the cutting operation. Furthermore, the support surface 36 is displaced outwards relative to the surface of the blade cylinder 10. Guiding grooves 40 are arranged in the counter-pressure cylinder 12. These grooves 40 are aligned with the gaps 32 and extend circumferentially around the cylinder 12. The belts 28 engage in these guiding grooves 40.

As illustrated in FIG. 6, when the blade 20 presses in the bottom of the cutting groove 34 it extends through each axial gap 32 and the belt 28 extends in the gap 32 with a radial spacing e from the blade. This spacing is preferably 1 mm. In a variant, this spacing is between 0.5 mm and 1.5 mm. In this manner, the blade 20 is not in contact with the belt 28 during the entire cutting operation and the belt 28 is not damaged by this blade 20.

Furthermore, the axial dimension of the gap 32 is selected so that the web 4 is cut by the blade 20 in the entire zone corresponding to the gap 32. The web 4 is thus cut over the entire width thereof in a single operation.

Figure 8:
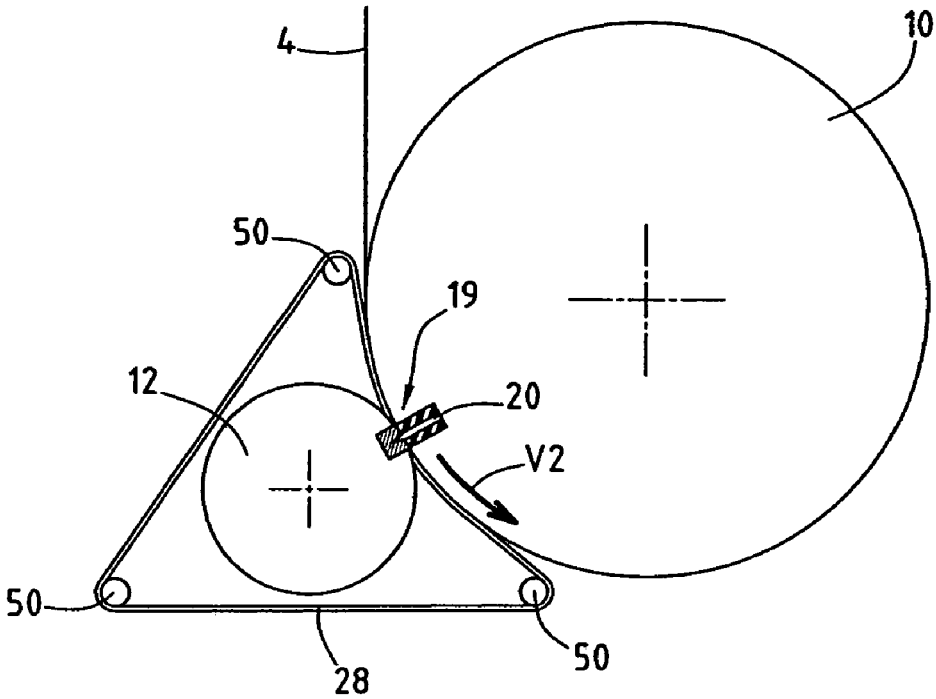
FIGS. 8 and 9 are schematic side views of folding devices according to second and third embodiments of the present invention.

FIG. 8 illustrates a second embodiment of the folding device according to the invention. This folding device 2 differs from that described above in the following manner. Elements which are similar have the same reference numerals.

The first belts 28 extend around a segment of the blade cylinder 10 upstream of the cutting location 19, and are capable of retaining the web 4 in a zone which extends upstream from the cutting location at the time of the cutting operation. In this manner, the end of the web 4 that is created by the cutting operation is retained. Furthermore, the first belts 28 completely surround the counter-pressure cylinder 12 and are deflected by three deflection rollers 50. Consequently, the first belts 28 are in contact with the counter-pressure cylinder 12 only in the zone defined by the counter-pressure elements 26 or are not in contact over the entire circumference of the counter-pressure cylinder 12.

This embodiment facilitates the driving of the first belts 28 at a speed $V_3$ which is different from the web speed $V_1$ or the signature speed $V_2$.

The second belts 30 are not illustrated in this Figure.

Figure 9:
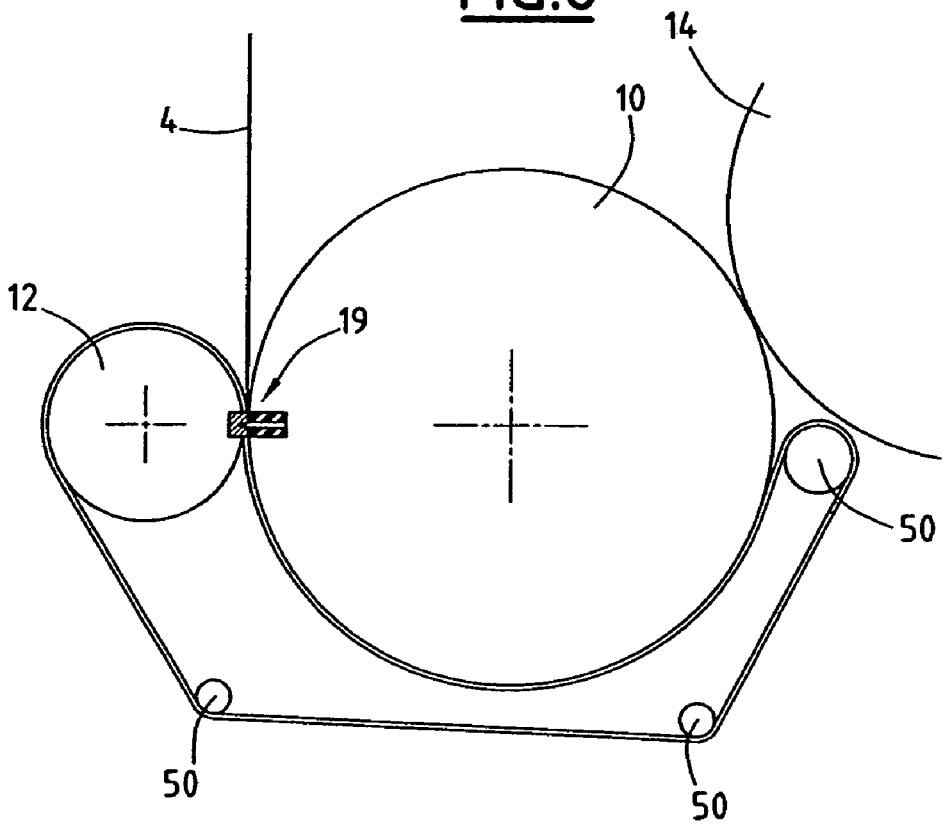

FIG. 9 illustrates a third embodiment of the folding device according to the invention.

This folding device 2 differs from the folding device described above in the following manner.

The first belts 28 press, downstream of the cutting location 19, against the blade cylinder 10 on a segment which corresponds to approximately 170°, that is to say, as far as a location for transferring the signature 18 to the transfer cylinder 14. The belts 28 thus extend around three return rollers 50.

Owing to this embodiment, the second belts 30 may be omitted whilst providing correct guiding of the cut signature 18 as far as the region of the transfer cylinder 14.

In a variant which is not illustrated, the counter-pressure pressure cylinder 12 carries a plurality of counter-pressure assemblies 25 or counter-pressure elements 26 which are distributed over the circumference thereof.

During operation, the blade cylinder 10 is capable of being rotatably driven so that the peripheral speed thereof is greater than the travel speed $V_1$ of the printed web 4 of material and is equal to the speed $V_2$.

In a variant, the blade cylinder 10 is capable of being rotatably driven so that the speed thereof is equal to the travel speed $V_1$ of the printed web 4 of material. In this instance, the speed $V_2$ is equal to the speed $V_1$.

Preferably, the counter-pressure assembly 25 and therefore the counter-pressure elements 26 are produced as a single component, the gap 32 between two counter-pressure elements being formed by a recess or a groove for guiding the belts 28. This variant facilitates the assembly and the production of the folding device.

Furthermore, the cutting groove 34 may be omitted.

It is self-evident that the belts 28 may be replaced with another conveying element, for example, a chain.

What is claimed is:

1. A folder capable of folding signatures comprising:

a blade cylinder with at least one blade capable of cutting a printed web of material, a counter-pressure cylinder with at least two counter-pressure elements together defining an axial gap, the blade pressing on the two counter-pressure elements during the cutting operation, a first conveying element extending around the counter-pressure cylinder, at least partially surrounding the blade cylinder, and capable of conveying the web and/or a signature cut from the web at least downstream of a cutting location, the first conveying element extending in the axial gap when the blade co-operates with the counter-pressure elements, the blade extending over the axial gap, the first conveying element extending in the axial gap with spacing from the blade when the blade co-operates with the counter-pressure elements.

2. The folder as recited in claim 1 wherein an axial width of the axial gap sufficiently small for the web to be cut by the blade in an entire zone corresponding to the axial gap.

3. The folder as recited in claim 1 wherein the blade cylinder carries a plurality of blades distributed over a circumference of the blade cylinder.

4. The folder as recited in claim 1 wherein the blade cylinder includes grippers for holding the signatures cut from the web.

5. The folder as recited in claim 4 wherein the grippers include pincers.

6. The folder as recited in claim 1 wherein the blade cylinder is capable of being rotatably driven so a peripheral speed of the blade cylinder is greater than a travel speed of the printed web of material.

7. The folder as recited in claim 1 wherein the blade cylinder is capable of being rotatably driven so a peripheral speed of the blade cylinder is equal to a travel speed of the printed web of material.

8. The folder as recited in claim 1 wherein the counter-pressure cylinder carries one assembly of counter-pressure elements.

9. The folder as recited in claim 1 wherein the blade is retracted behind a covering surface of the blade cylinder, and the blade is surrounded by protection blocks.

10. The folder as recited in claim 9 wherein the protection blocks are of rubber and capable of protecting the conveying element.

11. The folder as recited in claim 1 wherein the first conveying element includes at least a first belt provided with a transport surface and directed towards the printed web of material during operation.

12. The folder as recited in claim 11 wherein the first belt has a round or rectangular cross-section.

13. The folder as recited in claim 11 wherein the first conveying element extends around the blade cylinder upstream of the cutting location and is capable of retaining the web during the cuffing operation.

14. The folder as recited in claim 11 wherein the transport surface is smooth.

15. The folder as recited in claim 1 wherein the first conveying element extends around the blade cylinder as far as a transfer location for transfer of the signature, and is capable of transporting the signatures from the cutting location to the transfer location.

16. The folder as recited in claim 1 further comprising a first bank of conveying elements including the first conveying element and a second bank of conveying elements including second conveying elements surrounding the counter-pressure cylinder, the first bank being imbricated with the second bank, the first and second conveying elements being capable of transferring a signature to the second conveying elements.

17. The folder as recited in claim 16 wherein the second conveying elements extend around the blade cylinder are capable of retaining the signatures on a surface of the blade cylinder, a speed of the second conveying elements being identical to the tangential speed of the blade cylinder.

18. The folder as recited in claim 1 wherein the first conveying element is driven at a speed equal to or greater than a transport speed of the web.

19. The folder as recited in claim 1 wherein first conveying element is driven at a speed greater than a transport speed of the web and less than or equal to a transport speed of the signatures.

20. The folder as recited in claim 19 wherein the first conveying element transport speed is less than the transport speed of the signatures.

21. A rotary press comprising the folder as recited in claim 1.

* * * * *